United States Patent [19]

Sharples

[11] Patent Number: 4,959,642

[45] Date of Patent: Sep. 25, 1990

[54] INSTRUMENTATION LOOP-POWERED BACKLIT LIQUID CRYSTAL DISPLAY

[76] Inventor: Kenneth R. Sharples, 102 Herbert St., Braintree, Mass. 02184

[21] Appl. No.: 249,970

[22] Filed: Sep. 27, 1988

[51] Int. Cl.[5] ..... G09G 3/18

[52] U.S. Cl. ..... 340/716; 340/765; 340/784; 350/345; 324/96

[58] Field of Search ..... 340/784, 765, 762, 782, 340/815.03, 660, 661, 664, 716; 324/96; 350/331 R, 345; 362/29, 30

[56] References Cited

U.S. PATENT DOCUMENTS

| | | | |
|---|---|---|---|
| 4,431,966 | 2/1984 | Pucciarello | 324/96 |
| 4,438,396 | 3/1984 | Harden, Jr. et al. | 324/96 |
| 4,609,914 | 9/1986 | Fathi | 324/96 |
| 4,617,562 | 10/1986 | Klotz | 340/784 |
| 4,714,983 | 12/1987 | Lang | 350/345 |
| 4,806,854 | 2/1989 | Mayer et al. | 324/96 |
| 4,823,078 | 4/1989 | Mohebban | 324/96 |

*Primary Examiner*—Jeffery A. Brier

*Attorney, Agent, or Firm*—Joseph S. Iandiorio

[57] ABSTRACT

A loop-powered, backlit liquid crystal display (LCD) responds to a current instrumentation loop for providing a current representative of the value to be measured and an LCD for displaying the measured value. A light-emitting diode (LED) circuit, which includes an LED disposed proximate to the LCD, is interconnected with, and driven by, the current of the current instrumentation loop for backlighting the LCD.

18 Claims, 3 Drawing Sheets

INSTRUMENTATION LOOP-POWERED BACKLIT LIQUID CRYSTAL DISPLAY

FIELD OF INVENTION

This invention relates to a loop-powered backlit liquid crystal display and more particularly to a light emitting diode connected in series with an instrumentation loop for illuminating the display of an indicating meter.

BACKGROUND OF INVENTION

Liquid crystal display devices are becoming evermore widely used in the process control industry In process control applications, meters with liquid crystal displays (LCD) are often self-powered from the instrumentation loops used to transmit process parameters such as temperature, pressure and flow rates. The process parameters are commonly sensed by transducers such as flow transmitters which transmit current proportional to the sensed process parameter. The amount of current transmitted, typically 4–20 milliamps, is supplied to the loop and is calibrated by the meter which measures the voltage across a sensing resistor to indicate the measured value.

Often the LCD meters are used in areas where ambient light is insufficient for proper viewing or they may be encased in explosion proof or protective housings which limit the ambient light available to the LCD. In such applications independent lighting from a separate power source is necessary in order to illuminate the display.

SUMMARY OF INVENTION

It is therefore an object of this invention to provide an instrumentation loop-powered backlit liquid crystal display (LCD).

It is a further object of this invention to provide such a backlit liquid crystal display with an associated meter, powered by the instrumentation loop, to indicate the measured value.

It is a further object of this invention to provide such a loop-powered backlit LCD that minimizes the voltage drop in the instrumentation loop.

It is a further object of this invention to provide a power supply circuit for increasing the voltage used to drive a light source to illuminate the display without increasing the voltage burden on the instrumentation loop.

It is a further object of this invention to provide a loop-powered backlit LCD which protects the light source, used to illuminate the LCD, from an over current condition on the instrumentation loop.

It is a further object of this invention to provide such a loop-powered backlit LCD which regulates the current through the light source.

This invention results from the realization that a truly effective self-powered backlit liquid crystal display can be made by including a light emitting diode (LED) in the instrumentation loop proximate to the liquid crystal display for illuminating the display when ambient light is insufficient to permit the display from being read, the LED being powered by a voltage inverter connected in series with the instrumentation loop for providing the increased voltage necessary to drive the LED without increasing the voltage burden on the instrumentation loop.

This invention features a loop-powered, backlit liquid crystal display (LCD) which includes a current instrumentation loop for providing a current representative of a value to be measured and an LCD for displaying the measured value. A light emitting diode (LED) circuit having an LED is disposed proximate to the LCD and is interconnected with, and driven by, the current of the current instrumentation loop for backlighting the LCD.

In one embodiment biasing means are interconnected in series with the LED to form a bias circuit, and a current regulating amplifier is interconnected with the bias circuit and operated by the biasing means to regulate the current through the LED. The biasing means may include a second LED.

In another embodiment the LED circuit includes a voltage inverter circuit interconnected with the LED, the LED being connected with its anode to the positive terminal of the voltage inverter and its cathode connected to the negative terminal of the voltage inverter for increasing the voltage used to drive the LED. The LED circuit can further include a second LED in series with the first LED; the first and second LEDs are interconnected in parallel with the voltage inverter circuit.

In yet another embodiment, the loop-powered, backlit LCD includes a second LED in series with the first LED and biasing means interconnected in series between the LEDs to form a bias circuit. The bias circuit is connected at one end to the positive terminal of a voltage inverter and at the other end to the negative terminal of the voltage inverter. The LEDs are disposed proximate to the LCD. A light diffusing element can be disposed between the LEDs and the LCD for diffusely illuminating the LCD. Interconnected with the bias circuit is a current regulating amplifier which is operated by the biasing means to regulate current through the LEDs. A voltage inverter circuit interconnected with the bias circuit increases the voltage used to drive the LEDs without increasing the voltage burden on the instrumentation loop. The voltage used to drive the LCD is proportional to the current in the instrumentation loop and is developed across a resistor connected in series with the LED circuit. That voltage is sensed by a loop-powered meter for driving the LCD to display a measured value.

In an alternate construction, a loop-powered, backlit LCD includes terminal means for receiving current representative of a value to be measured, an LCD for displaying the measured value, and a light-emitting diode (LED) circuit which includes an LED disposed proximate to the LCD and interconnected, and driven by, the current for backlighting the LCD. The loop-powered, backlit liquid crystal display further includes transmitter means connected to the terminal means for generating the current representative of the value to be measured. The LED circuit also includes biasing means interconnected in series with the LED to form a bias circuit and a current regulating amplifier connected in parallel with the bias circuit. The current regulating amplifier is operated by the bias level at the junction of the LED and the biasing means for regulating the current through the LED. A voltage inverter circuit is also interconnected with the bias circuit, the bias circuit has one end connected to the positive terminal of the voltage inverter and the other end connected to the negative terminal of the voltage inverter for providing an increased voltage which is used to drive the LED without increasing the voltage burden on the instrument loop. The biasing means may include a resistor and a second LED. A second resistor is placed in series with the current regulating amplifier and the voltage inverter. A loop-powered meter interconnected with the second resistor senses the voltage developed across the second resistor for driving the LCD to display a measured value.

DISCLOSURE OF PREFERRED EMBODIMENTS

Other objects, features and advantages will occur from the following description of a preferred embodiment and the accompanying drawings, in which.

The loop-powered meter with a backlit liquid crystal display, according to the present invention, may be accomplished by a light emitting diode (LED) circuit which is used to backlight a liquid crystal display (LCD). The LED circuit is interconnected with and driven by a current instrumentation loop used to drive the meter. The LED circuit includes at least one LED disposed proximate to the LCD for illuminating the display. The LED is preferably a high light output LED such as a GaAsP/GaP. A light-diffusing element, such as a flat sheet of frosted acetate, can be disposed between the LED and the LCD to evenly illuminate the LCD.

In one construction, the LED circuit includes a resistor interconnected in series between two LEDs to form a biasing circuit. The brightness of the LED and the amount of current flowing through the LED is regulated by a current regulating amplifier which is connected in parallel and biased by the biasing circuit. The current regulating amplifier is a transistor having a high beta value such as 100. A DC to DC voltage converter such as an ICL 7660 is connected as an inverter in parallel with the voltage divider for increasing the voltage used to drive the LEDs without burdening the voltage available on the loop. A sensing resistor placed in series with the LED circuit develops a voltage that is proportional to the current in the loop. This voltage is measured by a self-powered meter which displays the measured value on the LCD.

In another construction, the LED circuit consists of one or more LEDs connected across a DC/DC voltage converter. The converter, operating as an inverter, increases the voltage necessary to drive the LEDs without increasing the voltage burden on the instrumentation loop. In this construction the brightness of and current through the LEDs are not controlled by a current regulating amplifier.

In a third construction, the LED circuit includes an LED placed proximate to the LCD and driven by the instrumentation loop. The current through the LED can be regulated by a current regulating amplifier.

Figure 1:
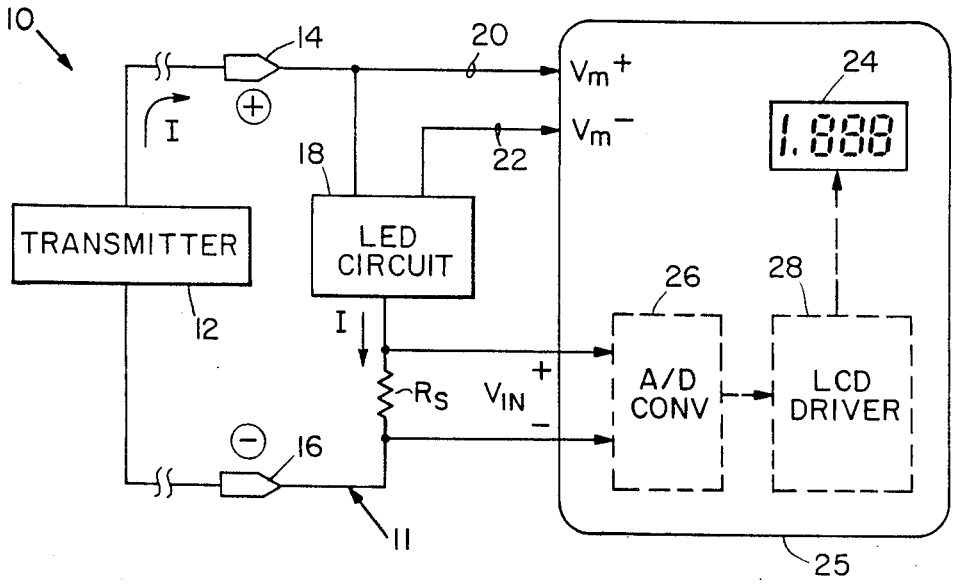
FIG. 1 is a schematic diagram of a loop-powered digital meter with backlit liquid crystal display.

In the preferred embodiment, a loop-powered, backlit LCD circuit 10, FIG. 1, includes an instrument current loop 11, which consists of an LED circuit 18 and a sensing resistor $R_s$ connected in parallel with a transmitter 12 at terminals 14 and 16. Current I is produced by transmitter 12 and is fed to LED circuit 18 for providing voltage to power meter 25 via lines 20 and 22, and for developing a voltage $V_{in}$ across a sensing resistor $R_s$, which is proportional to the current I. This voltage is converted to digital by an analog to digital converter 26 which drives an LCD driver 28 for displaying the measured value on LCD 24.

Figure 2:
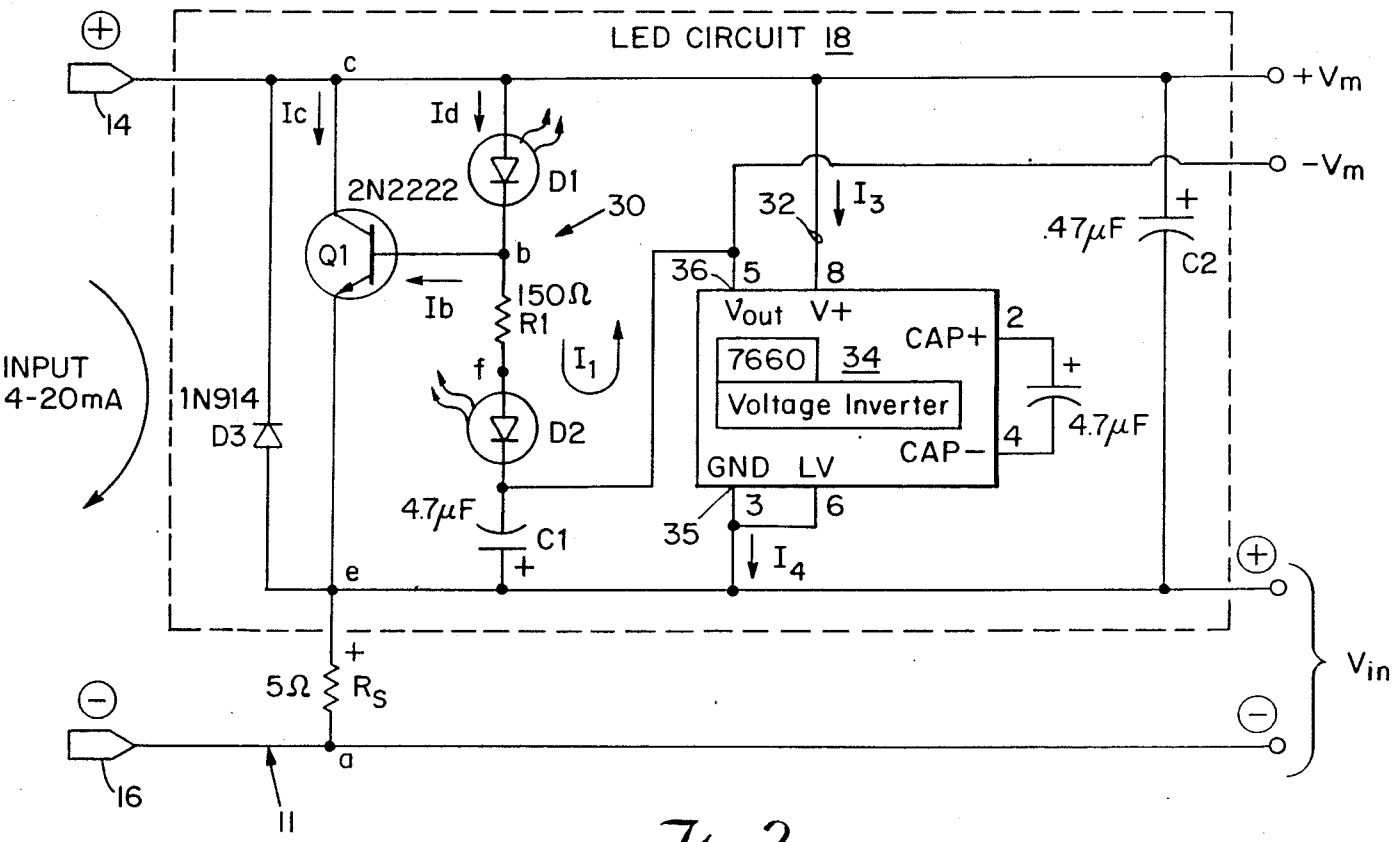
FIG. 2 is a schematic diagram of the LED circuit of FIG. 1.

The LED circuit 18, shown in greater detail in FIG. 2, includes a bias circuit 30 which consists of bias means, resistor $R_1$, placed between two LEDs $D_1$ and $D_2$. One end of the biasing circuit is connected to the positive terminal 14 of the current loop and to positive terminal 32 of a voltage inverter 34; the other end is connected to output terminal 36 of voltage inverter 34. The ground terminal 35 of voltage inverter 34 is connected to sensing resistor $R_S$. Voltage inverter 34 performs a voltage conversion of the voltage applied across its input terminal and ground terminal, resulting in a complementary output voltage $-V_m$ at its output terminal 36. The negative voltage at output terminal 36 is sufficiently negative to drive LEDs $D_1$ and $D_2$. The negative voltage $-V_m$ at output terminal 36 is also used in conjunction with positive terminal 14 for supplying power to drive A/D converter 26 and LCD driver 28 of voltage meter 25, FIG. 1.

A transistor $Q_1$ is connected in parallel with voltage inverter 34 to regulate the brightness of LEDs $D_1$ and $D_2$ by controlling the current through bias circuit 30. Transistor $Q_1$ is biased by connecting its base at junction b between LED $D_1$ and resistor $R_1$. Resistor $R_1$ establishes the voltage at the base of transistor $Q_1$ and thus the current level through diodes $D_1$ and $D_2$. A reverse current protection diode $D_3$ is connected in parallel with transistor $Q_1$ to protect the LED circuit 18 from reverse current conditions in the instrumentation current loop. Bypass capacitors $C_1$ and $C_2$ are also connected between output terminal 36 of voltage inverter 34 and the sensing resistor $R_s$ and between positive terminal 14 of the current loop and sensing resistor $R_s$, respectively.

The voltage from node c to e ($V_{ce}$) is regulated by $Q_1$ of LED circuit 18. $V_{ce}$ is equal to the forward voltage drop of $D_1$ ($V_{fd}$), plus the base emitter voltage of $Q_1$ ($V_{be}$).

$$V_{ce}=V_{fd}+V_{be} \quad (1)$$

Formula (2) is a simplified equation for the collector current of $Q_1$ in terms of base current ($I_b$) and the current transfer ratio beta ($\beta$).

$$I_c=\beta I_b \simeq 100 \quad (2)$$

By Kirchhoff's current law applied to node b.

$$I_b=I_d-I_1 \quad (3)$$

Substituting equation (3) into (2) we derive, $$I_c=\beta I_d-I_1 \quad (4)$$

Current $I_b$, can be expressed as $(V_b-V_f)R_1$, therefore, $$I_c = \beta\left[I_d - \left[\frac{(V_b - V_f)}{R_1}\right]\right] \quad (5)$$

When LED circuit 18 is in regulation, any attempted increase in $V_{ce}$ would result in a larger current $I_d$ than $I_1$. This is because $I_d$ increases exponentially with a corresponding voltage increase while $I_1$ would increase linearly. This difference in currents causes the flow of $I_b$, which in turn greatly affects $I_c$, as shown in formula 2.

Because only a fixed current flows into LED circuit 18 from loop 11, an increase in collector current decreases $I_d$ and $I_1$. This maintains $V_{ce}$ at its operating point and maintains a constant current through the diodes.

Since the beta of $Q_1$ is high (typically 100) the maximum value of $I_b$ is in the order of micro-amps and for all practical purposes both LEDs have the same regulated operating current.

Application of Kirchhoff's voltage law around the base-emitter loop shows how $R_1$ will set the current $I_1$.

$$V_{be} - I_1R_1 - V_{fd} = V_m = O \quad (6)$$

From formula (1) we know that $V_{be} = V_{ce} - V_{fd}$. Applying this to equation (6) gives, $$(V_{ce} - V_{fd}) - I_1R_1 - V_{fd} + V_m = 0$$

$$V_{ce} - I_1R_1 - 2V_{fd} + V_m = 0 \quad (7)$$

Solving for $I_1$ $$I_1 = \left[\frac{V_{ce} - 2V_{fd} + V_m}{R_1}\right] \quad (8)$$

Because all the terms in equation (8) are constant ($V_{ce}$, $V_{fd}$, and $V_m$, $R_1$ determines the magnitude of the constant current flow through the LEDs.

$I_4$ is the combined current of $I_1$ and $I_3$ plus any current flowing through the digital volt meter from the $V_m$ meter supply.

All the current flowing into the positive terminal 14 of the circuit from the current loop will pass through $R_S$ and return to loop 11 via negative terminal 16.

Since the voltage across the LED's and IC 34 is being regulated by Qthey will not be damaged by an over current condition in loop 11. The total current that can flow through the circuit is limited only by the power capability of $Q_1$ and $R_s$. The circuit has excellent inherent over-current protection.

Figure 3:
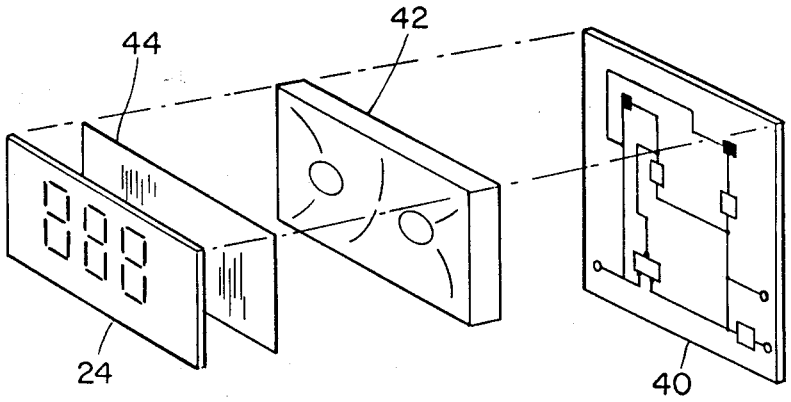
FIG. 3 is an exploded, three-dimensional view of a portion of the loop-powered meter having a self-powered backlit liquid crystal display of FIG. 1.

Referring to FIG. 3, diodes $D_1$ and $D_2$ are positioned on a printed circuit board 40 such that they extend through a reflective block 42 for illuminating LCD 24. Preferably a light diffuser 44 is disposed between LCD 24 and reflector block 42 for uniformly distributing light from LEDs $D_1$ and $D_2$ to display 24.

Figure 4:
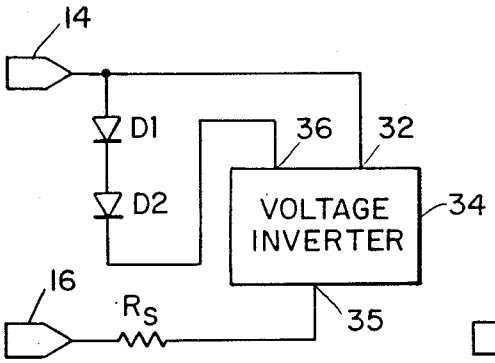
FIG. 4 is a schematic diagram of an alternative embodiment of the present invention.

Although a loop-powered, backlit LCD circuit has been described which regulates the LED current burden on the instrumentation loop, a backlit LCD circuit that does not regulate LED current can be accomplished by connecting two LEDs in series between the positive terminal 14 of the instrumentation loop and output terminal 36 of voltage inverter 34, as shown in FIG. 4. The positive terminal 32 of voltage inverter 34 is connected to the positive terminal 14 of the current instrumentation loop and the ground terminal 35 is connected in such a way as to return the current via $R_S$ to the transmitter, not shown.

Figure 5:
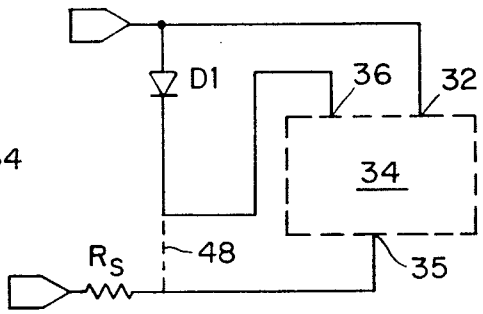
FIG. 5 is a schematic diagram of a second alternative embodiment of the present invention.

In an alternative construction, LED $D_1$ is placed directly across the positive and negative terminals 14 and 16 of the current instrumentation loop as indicated by a phantom connection 48 in FIG. 5. In another construction, LED $D_1$ is connected to voltage inverter 34 in a similar manner as described above.

Figure 6:
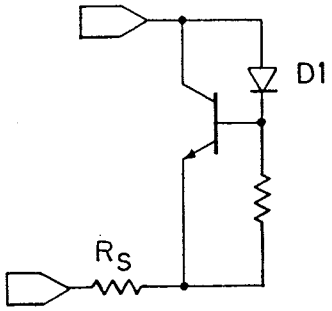
FIG. 6 is a schematic diagram of a third alternative embodiment of the present invention.

In still another construction the brightness of a backlit LCD can be controlled by regulating the current through LED $D_1$ as shown in FIG. 6. In this construction DC to DC voltage converter is not used for increasing the voltage required to drive LED $D_1$.

Although specific features of the invention are shown in some drawings and not others, this is for convenience only as each feature may be combined with any or all of the other features in accordance with the invention.

Other embodiments will occur to those skilled in the art and are with the following claims.

What is claimed is:

1. A loop-powered, backlit liquid crystal display (LCD) for displaying a measured value comprising:

a current instrumentation loop for providing a current representative of a value to be measured;

means for measuring the current value to provide a digital signal to an LCD;

an LCD responsive to said means for measuring for displaying the measured value; and a light emitting diode (LED) circuit including an LED disposed proximate to said LCD and interconnected with, and driven by the current of, said current instrumentation loop for backlighting said LCD.

2. The loop-powered, backlit LCD of claim 1 in which said LED circuit includes:

biasing means interconnected with said LED to form a bias circuit; and a current regulating amplifier interconnected with the bias circuit and operated by the biasing means to regulate the current through said LED.

3. The loop-powered, backlit LCD of claim 2 in which said biasing means further includes a second LED.

4. The loop-powered, backlit LCD of claim 1 in which said LED circuit includes a voltage inverter circuit interconnected with said LED, said LED being connected with its anode to the positive terminal of said voltage inverter and its cathode connected to the negative terminal of said voltage inverter for increasing the voltage used to drive said LED.

5. The loop-powered, backlit LCD of claim 4 in which said LED circuit further includes a second LED in series with the first LED, that said series of first and second LEDs connected in parallel with said voltage inverter circuit.

6. The loop-powered, backlit LCD of claim 1 in which said LED circuit further includes:

a second LED in series with the first LED;

biasing means interconnected with said LEDs to form a bias circuit;

a current regulating amplifier interconnected with the bias circuit and operated by said bias circuit to regulate the current through said LEDs; and a voltage inverter circuit interconnected with said bias circuit, said bias circuit having one end connected to the positive terminal of said voltage inverter and the other end connected to the negative terminal of said voltage inverter for providing the increased voltage used to drive said LEDs without increasing the voltage burden on said instrumentation loop.

7. The loop-powered, backlit LCD of claim 1 in which said LED circuit includes:

a second LED in series with the first LED;

biasing means interconnected with said LEDs to form a bias circuit;

a current regulating amplifier interconnected with said bias circuit and operated by said biasing means to regulate the current through said LEDs;

a voltage inverter bias circuit, said bias circuit having one end connected to the positive terminal of said voltage inverter and the other end connected to the negative terminal of said voltage inverter for increasing the voltage used to drive said LEDs without increasing the voltage burden on the instrumentation loop; and a resistor connected in series with said LED circuit for developing a voltage that is proportional to said current in said instrumentation loop, said voltage being sensed by a loop-powered meter for driving said LCD to display a measured value.

8. The loop-powered, backlit LCD of claim 7 in which said meter further comprises a light diffusing element disposed between said LEDs and said LCD for diffusely illuminating said LCD.

9. A loop-powered, backlit liquid crystal display (LCD) for displaying a measured value comprising:

terminal means for receiving current representative of a value to be measured;

means for measuring the current value to provide a digital signal to an LCD;

an LCD responsive to said means for measuring for displaying the measured value; and a light-emitting diode (LED) circuit including an LED disposed proximate to said LCD and interconnected and driven by said current for backlighting said LCD.

10. The loop-powered, backlit liquid crystal display of claim 9 further including transmitter means connected to said terminal means for producing said current representative of the value to be measured.

11. The loop-powered, backlit LCD of claim 9 in which said LED circuit includes:

biasing means interconnected with said LED to form a bias circuit;

a current regulating amplifier interconnected with the bias circuit and operated by the bias level at the junction of said LED and said biasing means to regulate the current through said LED; and a voltage inverter circuit interconnected with said bias circuit, said bias circuit having one end connected to the positive terminal of said voltage inverter and the other end connected to the negative terminal of said voltage inverter for providing the increased voltage used to drive said LED without increasing the voltage burden on the instrumentation loop.

12. The loop-powered, backlit liquid crystal display of claim 9 in which said biasing means includes a resistor and a second LED.

13. The loop-powered, backlit LCD of claim 12 further including:

a second resistor placed in series with said current regulating amplifier and said voltage inverter; and a loop-powered meter interconnected with said second resistor for sensing the voltage across said second resistor for driving the LCD.

14. A loop-powered, backlit liquid crystal display (LCD) for displaying a measured value comprising:

terminal means for receiving a current representative of a value to be measured;

means for measuring the current value to provide a digital signal to an LCD;

an LCD responsive to said means for measuring for displaying the measured value;

a light emitting diode (LED) disposed proximate to said LCD and interconnected and driven by the current of said current instrumentation loop for back lighting said LCD;

biasing means interconnected with said LED to form a bias circuit; and a current regulating amplifier interconnected with the bias circuit and operated by the biasing means to regulate the current through said LED.

15. The loop-powered, backlit liquid crystal display of claim 14 in which said biasing means includes a second LED.

16. A loop-powered, backlit liquid crystal display (LCD) for displaying a measured value comprising:

terminal means for receiving a current representative of a value to be measured;

means for measuring the current value to provide a digital signal to an LCD;

an LCD responsive to said means for measuring for displaying the measured value;

a light emitting diode (LED) disposed proximate to said LCD and interconnected and driven by current received by said terminal means for back lighting said LCD;

biasing means interconnected with said LED to form a bias circuit;

a current regulating amplifier connected to the bias circuit and operated by the biasing means to regulate the current through said LED; and a voltage inverter circuit connected to said bias circuit, said bias circuit having one end connected to the positive terminal of said voltage inverter and the other end connected to the negative terminal of said voltage inverter for providing the increased voltage used to drive said LEDs without increasing the voltage burden on the instrumentation loop.

17. A loop-powered, backlit liquid crystal display (LCD) for displaying a measured value comprising:

terminal means for receiving a current representative of a value to be measured;

means for measuring the current value to provide a digital signal to an LCD;

an LCD responsive to said means for measuring for displaying the measured value;

a first and second light emitting diode (LED) connected in series and disposed proximate to said LCD and interconnected and driven by current received by said terminal means for backlighting said LCD;

biasing means interconnected with said LEDs to form a bias circuit;

a current regulating amplifier connected to the bias circuit and operated by said biasing means to regulate the brightness of said LED; and a voltage inverter circuit connected to said bias circuit, said bias circuit having one end connected to the positive terminal of said voltage inverter and the other end connected to the negative terminal of said voltage inverter for providing the increased voltage used to drive said LEDs without increasing the voltage burden on the instrumentation loop.

18. A loop-powered, backlit liquid crystal display (LCD) for displaying a measured value comprising:

terminal means for receiving a current representative of a value to be measured;

means for measuring the current value to provide a digital signal to an LCD;

an LCD responsive to said means for measuring for displaying the measured value;

a light emitting diode (LED) disposed proximate to said LCD and interconnected and driven by current received by said terminal means for backlighting said LCD;

biasing means interconnected in series with said LED to form a bias circuit;

a current regulating amplifier connected in parallel with the bias circuit and operated by said biasing means to regulate the brightness of said LED;

a voltage inverter circuit connected in parallel with said bias circuit, said bias having one end connected to the positive terminal of said voltage inverter and the other end connected to the negative terminal of said voltage inverter for providing increased voltage used to drive said LED without increasing the voltage burden on the instrumentation loop; and said means for measuring connected in parallel with a resistor placed in series with said current regulating amplifier and said voltage inverter for sensing voltage developed across the resistor for driving the LCD display.

* * * * *